US007825869B2

(12) United States Patent
Masin et al.

(10) Patent No.: US 7,825,869 B2
(45) Date of Patent: Nov. 2, 2010

(54) MINIATURE TRANSPONDERS

(76) Inventors: Joseph V. Masin, 1313 Danielson Rd., Santa Barbara, CA (US) 93108; Barbara P. Masin, 1313 Danielson Rd., Santa Barbara, CA (US) 93108

( * ) Notice: Subject to any disclaimer, the term of this patent is extended or adjusted under 35 U.S.C. 154(b) by 200 days.

(21) Appl. No.: 12/214,832

(22) Filed: Jun. 23, 2008

(65) Prior Publication Data

US 2009/0009418 A1 Jan. 8, 2009

Related U.S. Application Data

(60) Provisional application No. 60/958,233, filed on Jul. 3, 2007.

(51) Int. Cl.
*H01Q 7/08* (2006.01)

(52) U.S. Cl. ..... 343/788; 29/600

(58) Field of Classification Search ..... 343/787, 343/788, 873, 872, 702; 29/600
See application file for complete search history.

(56) References Cited

U.S. PATENT DOCUMENTS

| | | | | |
|---|---|---|---|---|
| 5,084,699 | A | 1/1992 | DeMichele | 340/825.54 |
| 5,281,855 | A | 1/1994 | Hadden et al. | 257/784 |
| 5,572,410 | A | 11/1996 | Gustafson | 361/807 |
| 6,400,338 | B1 | 6/2002 | Mejia et al. | 343/873 |
| 6,947,004 | B2 | 9/2005 | Mejia et al. | 343/787 |
| 7,176,846 | B2 | 2/2007 | Mejia et al. | 343/873 |
| 7,425,929 | B2 * | 9/2008 | Sako | 343/788 |
| 7,545,337 | B2 * | 6/2009 | Guenther | 343/788 |
| 2007/0126650 | A1 * | 6/2007 | Guenther | 343/788 |
| 2007/0139288 | A1 * | 6/2007 | Shigemoto | 343/788 |

* cited by examiner

*Primary Examiner*—HoangAnh T Le
(74) *Attorney, Agent, or Firm*—O'Keefe, Egan, Peterman & Enders, LLP

(57) ABSTRACT

Systems and methods are disclosed for miniature transponders having capsule enclosure housings including a magnetic antenna core, such as a ferrite core, with a shaped form to provide space for an integrated circuit also included within the capsule enclosure housing. In addition, metal wire windings surround the antenna core, and these wires can be direct bonded to connections on the integrated circuit. Further, a stabilizing epoxy or other material can be inserted within the capsule enclosure housing to secure the antenna core and the integrated circuit within the capsule enclosure housing.

20 Claims, 3 Drawing Sheets

MINIATURE TRANSPONDERS

RELATED APPLICATIONS

This application claims priority to the following co-pending provisional application: Provisional Application Ser. No. 60/958,233 entitled "MINIATURE TRANSPONDERS," which was filed on Jul. 3, 2007.

TECHNICAL FIELD OF THE INVENTION

The present invention relates generally to miniature electronic devices and more particularly to miniature transponder devices suitable for implantation in living animals.

BACKGROUND

Prior miniature transponders exist. U.S. Pat. No. 5,281,855 describes a miniature transponder in which lead wires to an integrated circuit are connected using a direct bonding method. U.S. Pat. No. 5,572,410 describes a process for winding direct bonded wires around an antenna ferrite core used within a miniature transponder. U.S. Pat. No. 5,084,699 describes a system for using multiple coils to improve the performance of a miniature transponder. U.S. Pat. No. 7,176,846 describes a miniature transponder that electrically and mechanically mounts an integrated circuit to a support portion of an antenna ferrite core using a metallization layer.

SUMMARY OF THE INVENTION

Systems and methods are disclosed for miniature transponders having a capsule enclosure housings including a magnetic antenna core, such as a ferrite core, with a shaped form to provide space for an integrated circuit also included within the capsule enclosure housing. In addition, metal wire windings surround the antenna core, and these wires can be direct bonded to connections on the integrated circuit. Further, a stabilizing epoxy or other material can be inserted within the capsule enclosure housing to secure the antenna core and the integrated circuit within the capsule enclosure housing. Other features and related systems and methods are further described below.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION OF THE INVENTION

Systems and methods are disclosed for a miniature transponder having an extended antenna ferrite core formed to provide a space for an integrate circuit within a capsule enclosure housing. The miniature transponder can further include metal windings around the antenna ferrite core, and these metal windings can have direct bonded connections to the integrated circuit within the capsule enclosure housing for the miniature transponder. In addition, an epoxy or other material can be inserted into the capsule enclosure housing to secure the antenna core and the integrated circuit.

As discussed above, prior solutions exist for miniature transponders. Example solutions are described in U.S. Pat. No. 5,281,855, U.S. Pat. No. 5,572,410, U.S. Pat. No. 5,084,699 and U.S. Pat. No. 7,176,846, each of which is hereby incorporated by reference in its entirety. The miniature transponder embodiments described herein improve upon these prior solutions.

Advantageously, the embodiments described herein effectively utilize substantially all the available space within a given enclosure or capsule to accommodate the largest possible antenna assembly including a ferrite core and antenna coil/coils windings while still allowing a reliable functional attachment of an integrated circuit to the wire leads of the antenna ferrite core within the same enclosure. And these wired leads may be direct bonded to the integrated circuit. As further described below, an antenna ferrite core (or magnetic core), which extends substantially through the full length of the available space within a capsule enclosure, is shaped in such a way as to allow the miniature, direct-bonded integrated circuit to be located within the space provided by the pre-shaped end of the ferrite core. This use of the pre-shaped space allows for placement of the IC without increasing the overall length of the assembly beyond the length of the ferrite core and without requiring an increase in the size of the capsule. After placement of the direct-bonded integrated circuit (IC), the IC can be left loose within the capsule enclosure, or it can be glued to the side of the ferrite core after the direct-bonding process has been accomplished, as desired. Protection against shock and damage by vibration within the encapsulation can be accomplished by insertion of stabilizing epoxy or other material within the capsule. This stabilizing epoxy surrounds the ferrite core and the IC to hold them in place.

Systems and methods for a miniature transponder having an extended antenna ferrite core will now be discussed in more detail with respect to FIGS. 1A-B, 2, 3-4 and 5-6.

Figure 1A:
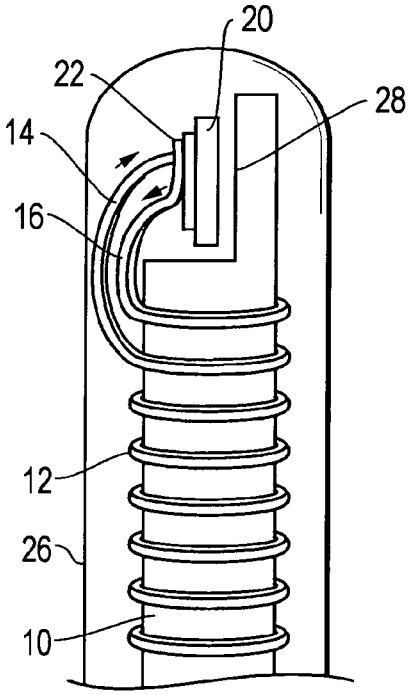
FIG. 1A is a side view diagram for a miniature transponder having an extended core with a pre-formed shape in which space has been provided for an integrated circuit.
Figure 1B:
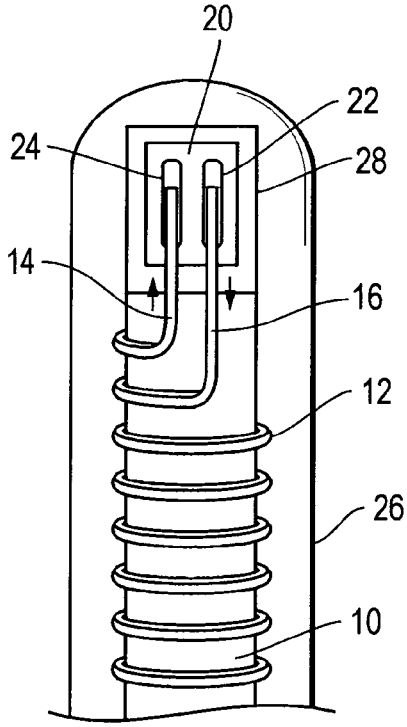
FIG. 1B is a top view diagram for a miniature transponder of FIG. 1A.

FIG. 1A is a side view diagram for a miniature transponder having an extended core with a pre-formed shape in which space has been provided for an integrated circuit. As depicted, a wire with ends 14 and 16 is wound around a core 10 to form windings 12. The windings 12 extend substantially along the length of the core 10. The core 10 can be an elongated cylindrical magnetic core such as a ferrite core. The wire ends 14 and 16 are direct bonded to the pads 22 and 24 (not shown), which are formed on integrated circuit 20. The pads 22 and 24 (not shown) can be formed as described in U.S. Pat. No. 5,281,855. It is noted that the FIG. 1B provides a depiction of wire ends 14 and 16 being bonded to and extending from pads 22 and 24. With respect to the other figures, it is further noted that the connections for wire ends 14 and 16 have been drawn so that both of the wire ends 14 and 16 can be seen. However, it is understood that the depiction of these connections are not intended as limiting the scope of the embodiments disclosed and described herein.

As indicated above, the antenna ferrite core 10 is shaped to provide space for the integrated circuit 20. As depicted, an L-shaped portion of the core 10 has been removed at one end of the core 10 to form a space in which to locate the integrated circuit 20. The integrated circuit 20 is then located in this L-shape section above the flat surface 28 in the pre-shaped form of the core 10. The transponder assembly including the core 10 and the integrated circuit 20 are then encapsulated within a suitable glass or plastics capsule 26. To provide the encapsulation, an epoxy or other material can first be injected into the capsule 26, then the transponder assembly, including the core 10 and the integrated circuit 20, can be lowered into the epoxy within the capsule 26. Once the epoxy cures, the transponder assembly is held securely within the capsule 26. It is noted that the transponder core could be placed first in the capsule 26, if desired, and then epoxy could be injected into the capsule 26.

It is noted that the space formed at the end of the core 10 allows for an extended core as compared to the solution described in U.S. Pat. No. 5,281,855 without altering the required size for the capsule 26. In addition, the direct bonding of wires 14 and 16 to integrated circuit 20 allows for more reliability and reduced space requirements for the integrated circuit 20 as compared to the solution described in U.S. Pat. No. 7,176,846. It is further noted that multiple loop winding structures, as described in U.S. Pat. No. 5,084,699, could also be utilized with respect to the windings on the antenna ferrite core.

FIG. 1B is a top view diagram for a miniature transponder of FIG. 1A having an extended core with a pre-formed shape in which space has been provided for an integrated circuit. As shown in FIG. 1B, wire 14 is direct bonded to pad 24, and wire 16 is directed bonded to pad 22. Otherwise, FIG. 1B has the same elements as does FIG. 1A.

Figure 2:
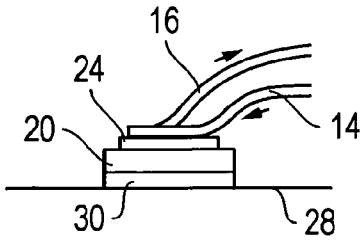
FIG. 2 is a diagram for an optional mechanical connection between the integrated circuit and the extended core.

FIG. 2 is a diagram for an optional mechanical connection between the integrated circuit and the extended core. Instead of relying partially or solely upon epoxy or other material injected within the capsule 26 to hold the core 10 and the integrated circuit 20 in place within the capsule 26, additional mechanical support can also be used. The layer 30 in FIG. 2A represents such a mechanical connection. This layer 30 can be for example a non-conductive glue, non-conductive adhesive, or other non-conductive material that will help hold the integrated circuit 20 in place. Although an epoxy or other material can still be injected within the capsule 26 to hold the components in place, this mechanical connection layer 30 can facilitate the positioning of the core 10 and integrated circuit 20 within the capsule during manufacture. As such, the mechanical connection layer 30 can be implemented as desired depending upon the level of connection strength desired. For example, a material could be used for connection layer 30 that is sacrificed during an epoxy injection process and is removed during the epoxy process or simply becomes part of the epoxy material once it hardens within the capsule 26 to hold the components in place.

Figure 3:
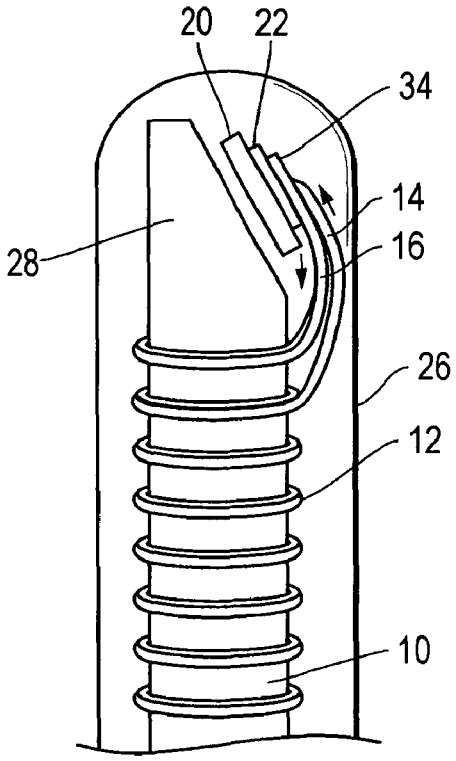
FIGS. 3-4 are diagrams for alternative embodiments for a miniature transponder having an extended core with a pre-formed shaped in which space has been provided for an integrated circuit.
Figure 4:
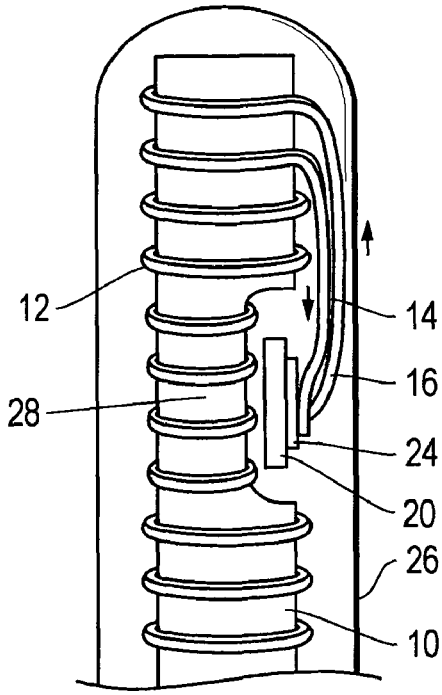

FIGS. 3-4 are diagrams for alternative embodiments for a miniature transponder having an extended core with a pre-shaped form in which space has been provided for an integrated circuit. For each of these embodiments, as with FIGS. 1 and 1A, an optional mechanical connection layer 30 could be utilized, if desired.

FIG. 3 is a diagram for an alternative embodiment where the space in the end of the core 10 for the integrated circuit 10 is a slanted surface 28.

FIG. 4 is a diagram for an alternative embodiment where the windings 12 extend substantially the full length of the core 10 without a section reserved for creating a space for the integrated circuit 20 as done with FIGS. 1A, 1B and 3. As depicted, a depression with a surface 28 has been formed in the side of the core 10 along its length. The windings 12 cover this depression. And the integrated circuit 20 sits in the space provided by the depression.

Figure 5:
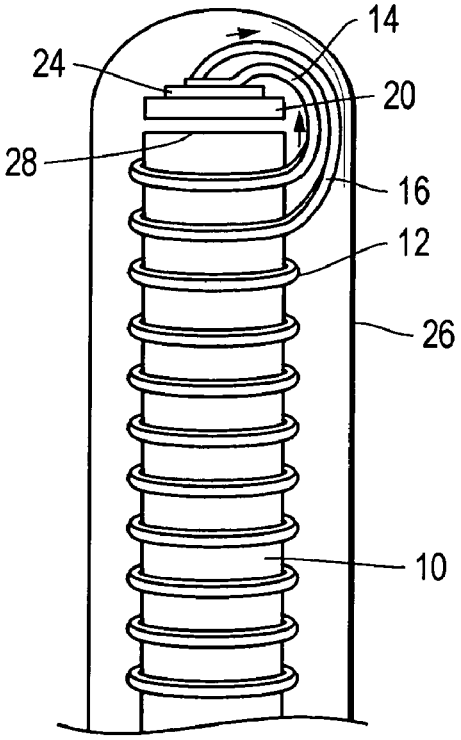
FIGS. 5-6 are diagrams for alternative embodiments for a miniature transponder including an integrated circuit positioned adjacent an extended core.
Figure 6:
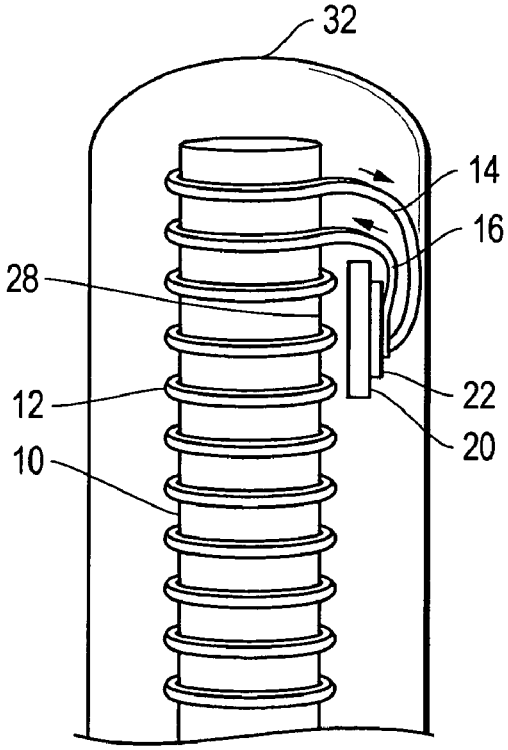

FIGS. 5-6 are diagrams for alternative embodiments for a miniature transponder including an integrated circuit positioned adjacent an extended core. For each of these embodiments, as with FIGS. 1 and 1A, an optional mechanical connection layer 30 could be utilized, if desired.

FIG. 5 is a diagram for an alternative embodiment in which the integrated circuit 20 is located at the one end of the core 10 in a plane perpendicular to the axis of the cylindrical core 10. In this embodiment, the surface 28 sits at the end of the core 10. To enhance this variation, the back side of the integrated circuit 20 to a reduced or minimal thickness so that it take up reduced space when positioned or glued adjacent the end of the ferrite core 10. In this implementation, the ferrite core would not need to be pre-shaped to provide a space for positioning the direct-bonded integrated circuit 10. If desired, however, the end of the core 10 could be pre-formed to provide a space for the integrated circuit 10. For example, the end of the core 10 could be provided with a concave shape so as to provide a space for the direct bonded integrated circuit 10.

FIG. 6 is a diagram for an alternative block diagram in which the integrated circuit 20 is positioned adjacent a side of the core 10 over the windings 12. It is noted that for this embodiment, assuming the core 10 remains relatively the same size, the capsule 32 would have to be larger than the capsule 26 used for the other depicted embodiments in order to make room for the integrated circuit 20.

As described above, these wire lead connections could be implemented using the method of direct bonding of antenna leads to an integrated circuit as described in U.S. Pat. No. 5,281,855. As such, there is no need to utilize additional components such as a PCB (printed circuit board), and the number of electrical connections are reduced or minimized thereby increasing the operational reliability of the device. By simplifying the required assembly, a fully automated assembly and high production rate is possible.

It is also noted that a flyer winding method can also be utilized such as the method described in U.S. Pat. No. 5,572,410. During manufacture, the ferrite core can be held stationary while the wire is wound around the ferrite core. This method allows for high speed winding of up to around 40,000 RPM and full control of wire leads. To initiate the process, the wire is guided over a first bond pad, such as a gold bump deposited on the surface of the integrated circuit (IC) to form an electrical communication with the circuitry on the IC. The wire is then is attached by a thermode bonding to the bond bad through the means of compression bonding. Thereafter, the wire continues to be wound around the ferrite core for number of desired turns before being guided over a second bond pad, such as a gold bump deposited on the surface of the integrated circuit (IC) to form an electrical communication with the circuitry on the IC. The wire is again attached by thermal compression bonding. The complete functional device is then severed from the end of the wire (which is typically coming from a spool of wire in the manufacturing process).

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. A miniature transponder, comprising:

a capsule enclosure;

a magnetic antenna core positioned within the capsule enclosure to provide an integrated circuit receiving space within the capsule enclosure, the integrated circuit receiving space being located adjacent a side of the antenna core within the capsule enclosure;

a wire wound around the antenna core having two wire ends extending into the integrated circuit receiving space;

an integrated circuit positioned within the integrated circuit receiving space without being mounted to the antenna core, the integrated circuit being electrically coupled to the two wire ends and not otherwise electrically coupled to the antenna core; and a material injected within the capsule enclosure to secure the antenna core and the integrated circuit in a fixed relationship within the capsule enclosure.

2. The miniature transponder of claim 1, wherein the antenna core has a shaped form to provide for the integrated circuit receiving space within the capsule enclosure.

3. The miniature transponder of claim 1, wherein the material comprises an epoxy.

4. The miniature transponder of claim 1, wherein the antenna core has an L-shaped portion at one end configured to provide the integrated circuit receiving space.

5. The miniature transponder of claim 4, wherein the wire is not wound around the L-shaped portion.

6. The miniature transponder of claim 1, wherein the antenna core has an slanted surface portion at one end configured to provide the integrated circuit receiving space.

7. The miniature transponder of claim 6, wherein the wire is not wound around the slanted surface portion.

8. The miniature transponder of claim 1, wherein the antenna core has an depression within its surface to provide the integrated circuit receiving space.

9. The miniature transponder of claim 8, wherein the wire is wound around the depression.

10. The miniature transponder of claim 1, wherein the two wire ends are direct bonded to the integrated circuit.

11. The miniature transponder of claim 1, wherein wire windings are included around a portion of the antenna core that is adjacent the integrated circuit receiving space.

12. The miniature transponder of claim 1, wherein the antenna core extends substantially through the full length of the available space within the capsule enclosure.

13. A method of manufacturing an miniature transponder, comprising:

providing a capsule enclosure;

providing a magnetic antenna core;

winding a wire around the antenna core so that two wire ends extend from the antenna core;

coupling the two wire ends to an integrated circuit;

injecting a material within the capsule enclosure;

positioning the antenna core within the capsule enclosure to provide an integrated circuit receiving space within the capsule enclosure, the integrated circuit receiving space being located adjacent a side of the antenna core within the capsule enclosure;

positioning the integrated circuit within the integrated circuit receiving space within the capsule enclosure without mounting the integrated circuit to the antenna core; and allowing the injected material to secure the antenna core and the integrated circuit in a fixed relationship within the capsule enclosure.

14. The method of claim 13, wherein the antenna core has a shaped form to provide for the integrated circuit receiving space within the capsule enclosure.

15. The method of claim 13, wherein the injecting step occurs before the positioning steps.

16. The method of claim 13, wherein the injecting step occurs after the positioning steps.

17. The method of claim 13, wherein the injecting step comprises injecting an epoxy.

18. The method of claim 17, further comprising utilizing an additional material to position the antenna core and the integrated circuit with respect to each other during the positioning steps, wherein the injected material is still what secures the antenna core and the integrated circuit in a fixed relationship within the capsule enclosure after manufacture is completed.

19. The method of claim 13, wherein wire windings are included around a portion of the antenna core that is adjacent the integrated circuit receiving space.

20. The method of claim 13, wherein the antenna core extends substantially through the full length of the available space within the capsule enclosure.

* * * * *